United States Patent [19]

Fisher

[11] 4,230,446

[45] Oct. 28, 1980

[54] CAMP LANTERN

[75] Inventor: Robert E. Fisher, Glendora, Calif.

[73] Assignee: Acroform Corporation, Los Angeles, Calif.

[21] Appl. No.: 912,507

[22] Filed: Jun. 5, 1978

[51] Int. Cl.[3] ..... F23D 11/38

[52] U.S. Cl. ..... 431/123; 431/107; 137/625.4;625.48;244; 239/117

[58] Field of Search ..... 431/103, 106, 107, 123; 137/625.4, 625.48; 251/251; 137/244; 239/117

[56] References Cited

U.S. PATENT DOCUMENTS

| | | | |
|---|---|---|---|
| Re29,457 | 10/1977 | Hastings | 431/123 |
| 2,271,231 | 1/1942 | Platt et al. | 137/625.48 |
| 2,517,061 | 8/1950 | Von Stackelberg | 137/625.48 |
| 2,664,729 | 1/1954 | Bramming | 431/123 |
| 3,000,399 | 9/1961 | Bruckner | 137/625.48 |
| 3,503,540 | 3/1970 | Fuerst | 137/625.4 |
| 3,876,364 | 4/1975 | Hefling | 431/123 |
| 4,078,579 | 3/1978 | Bucko, Sr. | 137/625.48 |

*Primary Examiner*—Carroll B. Dority, Jr.
*Assistant Examiner*—Lee E. Barrett
*Attorney, Agent, or Firm*—John E. Wagner

[57] ABSTRACT

An improved camp lantern comprising a spool fuel/air valve with OFF, START and RUN modes of operation is described. The spool valve is contained within a cylindrical valve chamber having fuel and air inlets and an outlet port leading to the lantern generator. The spool valve shaft also comprises a ramp contacting a cam follower for driving a rod and orifice cleaning needle. The needle enters and clears the generator orifice when the valve is in the OFF position. Thus, operating the valve in normal use also automatically clears the generator orifice. In addition to the operating convenience of this valve assembly, the parts count is low and the parts are easily machinable, making this lantern valve assembly reliable and economically producable in commercial quantities.

8 Claims, 6 Drawing Figures

CAMP LANTERN

BACKGROUND OF THE INVENTION

This invention relates to camp lanterns and, more particularly, to a valve for operating a camp lantern comprising a minimum of parts and producable economically in commercial quantities.

A typical camp lantern comprises a tank assembly for holding the fuel and contains a built-in air pump for pressurizing the fuel. The fuel is supplied under pressure through a metering valve assembly which typically has three positions, OFF, START and RUN. The fuel (or fuel and air in the START mode) rises under pressure through a generator tube and is injected into an air conduit or air intake tube which is ultimately connected to several mantles at which the actual combustion and light generation takes place.

In the RUN mode of operation, fuel under pressure is supplied through the valve assembly to the generator section which is heated by the combustion taking place in the mantles. In this generator section, the liquid fuel is evaporated into a gaseous form and is sprayed under pressure into the air intake tube. This air intake tube is a vertical cylindrical tube open at the bottom for receiving air and connected at the top to one or several mantles. Air rises in this tube partly because of the heat generated by the combustion at the mantles and partly because of the action of the evaporated fuel being sprayed upwardly into this tube. The result is a fuel-air mixture which is carried to the mantles. The mantles provide heat as well as light and are located in close proximity to the generator and the air intake tube, thus providing for the steady state operation of the lantern in the RUN position by preheating the fuel air mixture.

To start the lantern, heat must initially be supplied to the generator and air intake tube sections. This is done by providing the valve assembly with a START capability comprising a mechanism for supplying air as well as fuel to the generator section. This mechanism in the prior art has been either a separate air valve or an integral part of the valve assembly itself. Air and fuel under pressure are both supplied from the tank assembly to the generator section, the resultant combustion mixture being sprayed directly into the air intake tube for combustion at the mantles. Combustion at the mantles proceeds under this mode of operation until the generator section has been heated to the point where it will vaporize the fuel contained therein. At that point, the valve is positioned to its RUN position, cutting off the flow of air from the tank assembly into the generator. From this position, the valve supplies only fuel, air rises in the air intake tube automatically, and the RUN mode of operation is thus initiated and maintained.

At the top of the generator a cap is provided which has an orifice in the order of about eight thousandths of an inch diameter in the described embodiment. Partly because of impurities in the fuel supply and partly because some combustion takes place at this generator orifice, especially at the time when the lantern is turned OFF, it is common for this generator orifice to become blocked. Thus, it is necessary that camp lanterns be supplied with some kind of cleaning needle to periodically clear this orifice.

One method of clearing this orifice has been to supply the lantern with a cleaning tool in the form of a correctly sized needle and a mechanism for driving said needle into and out of the orifice. This needle mechanism is conveniently built into the lantern. See, for instance, U.S. Pat. No. 3,529,911.

In an improved prior art camp gas stove, a cleaning needle is coupled to the flow adjustment valve so that this cleaning is accomplished automatically. In this embodiment a rotating flow valve is used to open and close the fuel intake line. In intermediate positions, it varies the fuel flow rate to the stove burner. A rod couples the cleaning needle to the flow valve so that when the valve is fully closed, the needle is forced into the orifice, but when the valve is opened to allow the lantern to function in its normal operating range, the needle is withdrawn from the orifice. In this case, the needle cleaning mechanism is automatically driven by the flow valve mechanism. In the lantern embodiment disclosed herein, there is no flow valve.

There are three requirements that must be accomplished by the valve assembly and ancillary mechanisms in a camp lantern. The valve assembly must supply an air fuel mixture to the generator in the START mode, it must supply fuel to the generator in the RUN mode, and the valve assembly or ancillary apparatus must be provided to periodically clear the generator orifice. The valve and orifice cleaning apparatus frequently comprise a large number of parts and contribute to the unreliability and difficulty in use of the typical camp lantern. What is required is a camp lantern valve assembly which is convenient in operation and which uses a minimum number of parts so that the unit may be mass produced economically.

SUMMARY OF THE INVENTION

The inventive apparatus is a standard camp lantern comprising a valve assembly of simplified construction adapted to be producable on automatic machinery to allow economical production in commercial quantities.

The valve is an adaptation of the basic spool valve. The valve shaft is a cylindrical piece of stock which is turned down on a lathe, and the valve body is produced from rectangular stock with various portions drilled, threaded or tapped. The valve seals are standard fuel resistant "O" rings, and the cleaning needle is coupled to the valve shaft through a spring driven cam follower. The resultant valve assembly has a low parts count, can be produced economically, is reliable and has an automatic orifice cleaning capability. Two lines from the tank assembly supply air and liquid fuel to the valve assembly. When the valve shaft is in the START position, the generator tip orifice is held open and both air and fuel are allowed to enter the generator tube through the valve assembly to enable the START mode. When the valve is placed in its RUN position, the generator orifice is held open and only fuel is allowed to enter the valve assembly and thereafter the generator to enable the RUN mode of operation. In the OFF valve position, both the air and fuel supplies to the valve and generator are cut off. Furthermore, the needle is forced into the orifice cleaning as well as closing it. The next time the lantern is used, when the valve is returned to its START position, the needle is automatically retracted from the orifice. In this way, no separate cleaning step need be accomplished by the lantern operator, the operation of the valve automatically taking care of the orifice cleaning operation.

It is thus an object of this invention to provide a camp lantern valve assembly which is economical to produce, is convenient in use and will automatically clear the orifice without requiring the operator to perform any additional steps other than to set the valve assembly to its OFF, START and RUN positions.

BRIEF DESCRIPTION OF THE DRAWINGS

This invention may be more clearly understood from the following detailed description and by reference to the drawings in which.

DETAILED DESCRIPTION OF THE INVENTION

Figure 1:
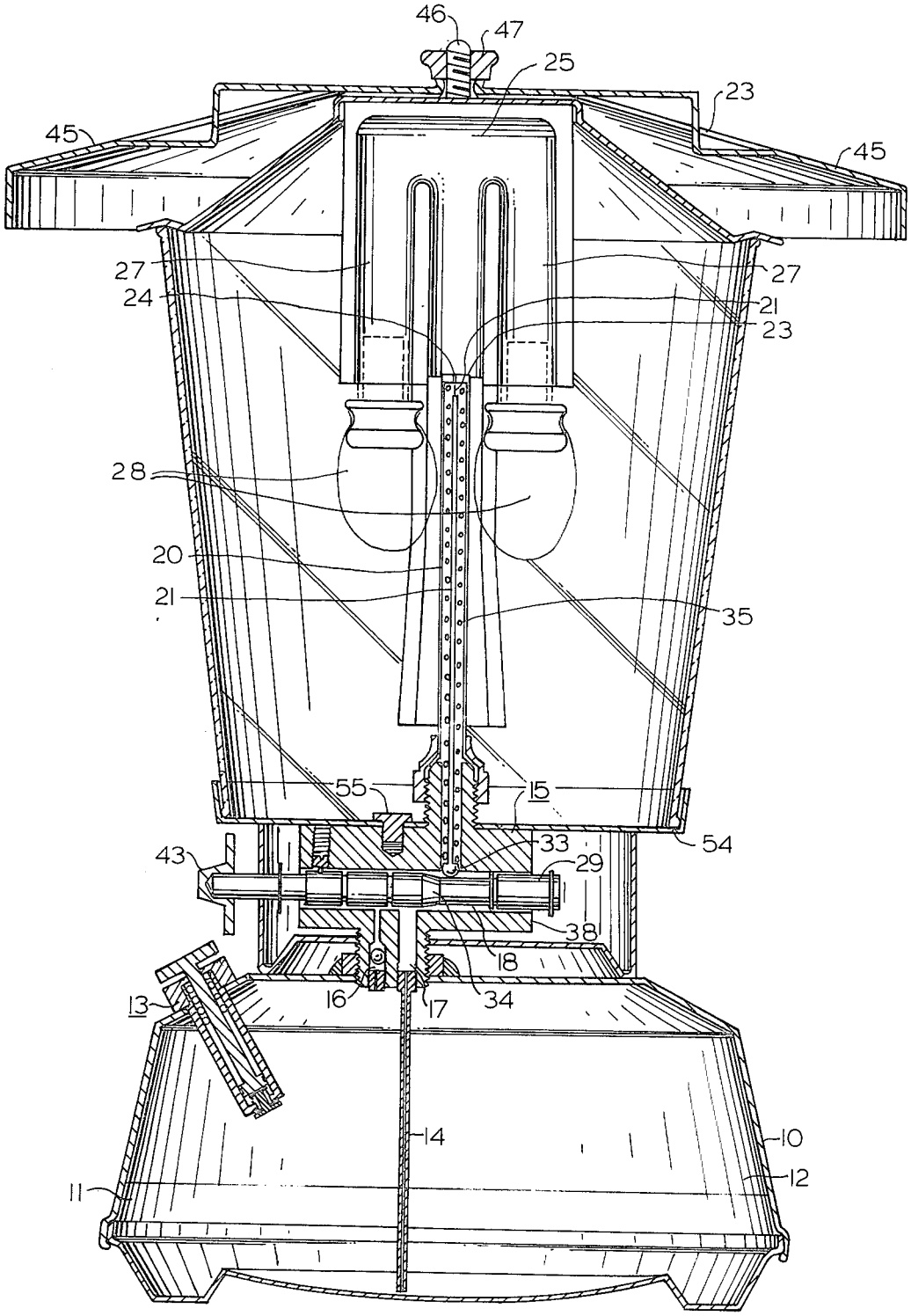
FIG. 1 is an overall front view, partly in section, of the camp lantern in which this valve assembly is used.

The lantern in which this inventive valve is used is shown in FIG. 1. The tank assembly 10 contains fuel 11 and air 12, both under pressure supplied by hand pump 13. A fuel tube 14 extends from the bottom of the tank assembly 10 and supplies liquid fuel to the fuel inlet 17 of the valve assembly 15. Air inlet 16 is open to the upper part of the tank assembly 10 and supplies air under pressure to the valve assembly 15.

The fuel or fuel/air mixture is supplied by the valve assembly 15 through the generator 20 and through an orifice 24 to an air intake tube 25. Air enters the open bottom of this tube 25, mixes with the fuel and is delivered to the mantles 28 for combustion. A spring 49 holds globe 48 on a base plate 54 surrounds and protects the mantles 28. A reflector assembly 45 is attached to the air intake tube 25 by means of a mounting bolt 46 and knurled nut 47.

In operation, the knob 43 is rotated to its OFF, START or RUN position. In the OFF position, neither air nor fuel are allowed to enter the valve chamber 18. In the START position, air and fuel in metered amounts are supplied by the valve assembly 15 through the generator 20 and air intake tube 25 to the mantles 28 where combustion takes place. When their combustion has continued long enough to heat the generator 20, the knob 43 may be rotated to the RUN position, in which fuel, but not air, is supplied by the valve assembly 15 to the generator 20 where it is vaporized. The fuel vapor is forced through the generator orifice 24 into the air intake tube 25 where it is mixed with air. The resulting mixture is then burned at the mantles 28.

The generator orifice 24 has a tendency to block. To automatically clear this orifice 24, a needle 22, driven by a rod 21, is provided. This rod 21 comprises a cam follower 33 at its lower end which contacts a ramp 34 on the valve shaft 29. This ramp 34 is located on the shaft 29 so that the needle 22 occupies the orifice 24 when the valve 15 is in the OFF position, but withdraws to allow normal operation in the START and RUN positions. Thus, the normal operation of the valve keeps the generator orifice 24 clear, and a separate orifice cleaning procedure and apparatus is not required.

Figure 2:
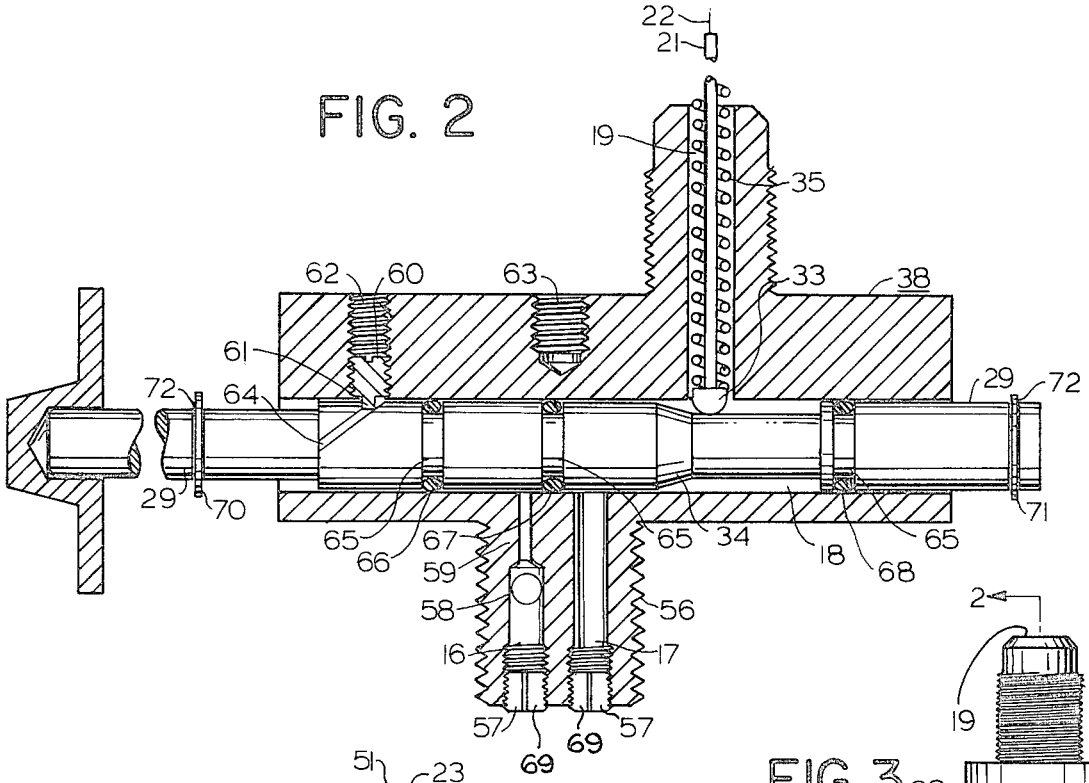
FIG. 2 is a cross-section of the valve body and shaft taken along line 2—2 of FIG. 3.

FIG. 2 is a sectional side view of the valve body 38. The bottom portion 56 of the valve body 38 is threaded and is secured into the top of the tank 10 by means of matching threads. This bottom portion 56 comprises an air inlet 16 and a fuel inlet 17. Each inlet is internally threaded to receive a set screw 57 in which is drilled an orifice 69 for metering the air and fuel flow. In the described embodiment the fuel orifice is sixteen thousandths of an inch and the air orifice, twenty-two thousandths.

During the START mode of operation, air and fuel are forced into the inlets 16, 17 by means of tank pressure. When the tank is full, these pressures are substantially equal, but when the tank is nearly empty, a pressure differential exists. This is a result of the fuel in the fuel tube 14 of FIG. 1 reducing the pressure at the fuel inlet 17. Under this circumstance, too little fuel per unit of air enters the valve chamber 18. To correct for this tendency, a steel ball 58, shown in FIG. 2 is supplied inside the air inlet 16. In the described embodiment the 0.125 inch diameter ball 58 nearly fills the air inlet 16 which is drilled in the valve body 38 with an 8/32 drill. The resultant resistance to air flow prevents an excessive amount of air from entering the valve chamber 18 under low fuel conditions. A restriction in the form of a reduced diameter section 59 holds the ball 58 in the air inlet 16. As will be discussed below, the valve shaft 29 and "O" ring 67 will open or close the air inlet 16 and fuel inlet 17, depending of the position of the OFF, START, RUN knob 43.

An outlet port 19 directs the fuel/air mixture to the generator 20.

Cap screw 60, with an integral dog portion 61 is positionally adjustable in its threaded hole 62. This dog 61 rides in a helical slot 64 in the valve shaft 29. Bolt hole 63 allows the base plate 54 of FIG. 1 to be attached to the valve assembly by a bolt 55.

The valve shaft 29 has a helical slot 64 which engages the dog 61 of the cap screw 60. Therefore, as the knob 43 rotates the valve shaft 29, the shaft 29 will simultaneously slide left or right. The helical slot 64 is machined so that there will be ninety degrees between each of the OFF, RUN and START positions.

The shaft has three slots 65 in which are mounted three "O" rings 66, 67 and 68, made of fuel resistant material, Neoprene or the like. These "O" rings 66, 67 and 68 seal the annular space between the shaft 29 and the valve chamber 18 walls. The first "O" ring 66 is always located to the left of the air inlet 16, and the third "O" ring 68 is always located to the right of the outlet port 19. The result is that the tank pressure, felt at the two inlets, is never allowed to bleed out through the ends of the valve chamber 18. The second "O" ring 67 is either positioned to the left of the air inlet 16, to the right of the fuel inlet 17, or between the inlets, enabling the OFF, START and RUN modes of operation, respectively. To maintain the shaft 29 within the open-ended valve body 38, two snap rings 70, 71 or lock rings are snapped onto slots 72. The greater diameter of the rings 70,71 compared to the inside diameter of the valve chamber 18 maintains the valve chamber 18 between the snap rings 70, 71 at all times, and therefore limits the allowed axial movement of the shaft 29 in the valve body 38.

The ramp 34 is used in conjunction with the generator rod 21 to clear the orifice as the valve shaft 29 is cycled through its positions.

Figure 3:
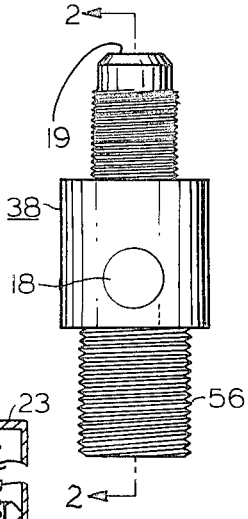
FIG. 3 is an end view of the valve body.

FIG. 3 is an end view of the body 38 showing the bottom portion 56 which is threaded into the tank 10, and the outlet port 19 which is threaded into the generator 20. The valve chamber 18 is simply a bore through the body 38 for receiving the valve shaft 29.

Figure 4:
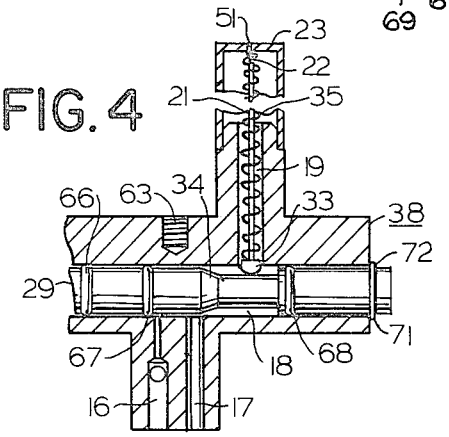
FIG. 4 is a partial cross-section of the valve in the START position.
Figure 5:
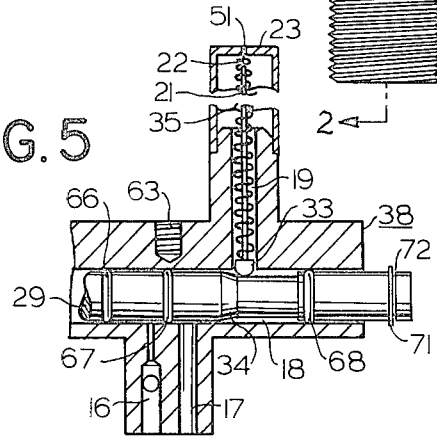
FIG. 5 is a partial cross-section of the valve in the RUN position.
Figure 6:
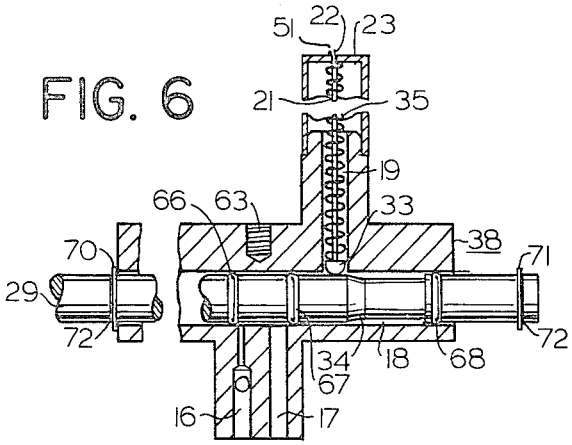
FIG. 6 is a partial, cross-section of the valve in the OFF position.

A more detailed description of each mode of operation in conjunction with FIGS. 4, 5 and 6 follows.

START POSITION

As shown in FIG. 4, in the START position, the shaft 29 is positioned fully to the left, the shaft motion stopped by the snap ring 71 contacting the valve body 38. Fuel entering through the fuel inlet 17 and air entering through the air inlet 16 may enter the valve chamber 18 and proceed out through the valve outlet port 19.

The mixture under pressure leaves the valve outlet port 19 and enters the generator 20. Central to the generator tube 20 is a rod 21 topped by a needle 22. At its top, the generator 20 has a cap 23 in which is drilled an orifice 24 with a diameter, in the preferred embodiment, of ten thousandths of an inch. In the START position, the pressure in the tank assembly generated by the hand pump 13 of FIG. 1 is felt through the valve assembly 15 and through the generator 20 at the generator orifice 24 resulting in the fuel air mixture in the generator 20 being sprayed into the air intake tube 25.

This air intake tube 25 as shown in FIG. 1, is a hollow metallic tube whose lower end 26 is open. The fuel and air mixture which is sprayed from the orifice 24 rises in the air intake tube 25 through the central portion and then falls through a plurality of side branches 27 to a plurality of mantles 28 where the combustion takes place. In the described embodiment, two side air branches 27 and mantles 28 are used. The combustion takes place within the mantles 28 thereby heating the central air intake tube 25 and the generator 20. When the generator tube 20 becomes hot enough to vaporize the fuel, the valve 43 can be set to the RUN position.

RUN POSITION

In the RUN mode, the valve shaft 29 is positioned as shown in FIG. 5 with neither snap ring in contact with the valve body 38. The second seal 67 is positioned between the air inlet 16 and the fuel inlet 17, cutting off the supply of air to the valve chamber 18. In this mode of operation, the fuel, under pressure, rises through the fuel inlet 17, through the valve chamber 18 and through the valve outlet port 19 into the generator 20, at which point the fuel is vaporized by the heat of the generator 20. The pressure in the tank assembly as a result of operation of the hand pump 13 is felt through the valve assembly 15 and into the generator 20. Thereafter, the vaporized fuel is forced out through the generator orifice 24 at a rate determined by the diameter of this orifice 24. Because of the combined action of this fuel spray and the natural tendency of the air within the air intake tube 25 to rise upon being heated, the fuel air mixture rises through the air intake tube 25 to be supplied through the side air branches 27 to the mantles 28.

OFF POSITION

To turn off the lantern, as shown in FIG. 6, the valve shaft 29 is moved to the right until the snap ring 70 contacts the valve body 38. This positions the second seal 67 so that it is to the right of the fuel intake 17 and to the left of the valve outlet port 19. Thus positioned, both the air inlet 16 and the fuel inlet 17 are blocked. Furthermore, rod 21, the bottom of which is coupled through a cam follower 33 to the valve shaft 29, is forced into an upper position because of the ramp 34 on the valve shaft 29. At all times, the rod 21 and the cam follower 33 are biased toward the valve shaft 29 by means of a biasing means such as a helical spring 35, the upper end of which is seated against the generator tube cap 23 and the bottom of which is seated against the cam follower 33. This spring 35 is helical and occupies part of the space between the rod 21 and the generator tube 20.

As is shown in this diagram, as the valve shaft 29 is moved into its OFF position, the needle 22 is forced into the orifice 24. Likewise, when the valve is positioned to its START position, the needle 22 is retracted from the orifice 24. In this way, the operator cleans the orifice 24 as a part of the normal action of turning the lantern ON and OFF.

An obstruction 51 is shown partially blocking the orifice 24 in FIGS. 4 and 5. By the action of the needle 22 being moved into the orifice 24 when the valve is placed in the OFF position, FIG. 6 shows this obstruction 51 being dislodged.

The use of this valve assembly improves the cost and operation of the camp lantern in various ways. First, the cost of manufacture is considerably below alternative embodiments since the relatively small part count and easy mahinability of the valve parts contributes not only to economic manufacture but also to increased reliability. Particularly, the valve shaft 29 can be produced at low cost on an automatic screw machine. The housing similarly may be produced on a standard milling machine or die forging machine and the various inlets and chambers produced by drilling, threading and tapping operations. To reduce costs further, the housing 38 could be fabricated from plastic.

This apparatus is also convenient from the operators point of view since no separate orifice 24 cleaning step is necessary. The normal START, RUN, OFF action of the valve shaft 29, coupled through cam follower 33 and the rod 21, is sufficient to drive the needle 22 into and out of the orifice 24, thus automatically cleaning it without any additional action on the part of the lantern operator. If the generator orifice should become blocked during use, cycling the valve through the OFF position should clear the orifice 24.

The above described embodiment of this invention is merely descriptive of its principles and is not to be considered limiting. The scope of this invention instead shall be determined from the scope of the following claims including their equivalents.

What is claimed is:

1. A camp lantern spool valve assembly comprising;

a hollow cylindrical valve chamber comprising in positional order (a) a sealed first end;

(b) an outlet port;

(c) a fuel inlet;

(d) an air inlet; and (e) an open second end;

a valve shaft axially slidably mounted within said chamber;

means for limiting the axial movement of said shaft in said chamber, and first and second sealing means on said shaft for sealing the space between said shaft and said chamber;

said first sealing means positioned intermediate said second end and said air inlet; and said second sealing means positioned either (a) intermediate said air inlet and said second end;

(b) intermediate said air and fuel inlets, or (c) intermediate said fuel inlet and said outlet port, depending on the axial position of said shaft in said chamber;

wherein said sealing means comprises fuel resistant "O" rings mounted on said shaft;

wherein said first end is sealed by a third "O" ring mounted on said shaft intermediate said first end and said outlet port;

further comprising threaded means coupling said shaft to said chamber so that a rotation of said shaft results in an axial shaft motion relative to said chamber;

wherein said shaft extends beyond both ends of said chamber, and wherein said means for limiting the axial movement of said shaft comprises a snap ring on each shaft end of greater diameter than that of said chamber;

wherein said valve shaft member further comprises a ramp portion proximate to the outlet port location;

a cam follower adapted to contact said ramp;

a generator connected to said outlet port at a first end and having an orifice at its second end;

a rod internal to said generator and attached to said cam follower at said rod's first end; and a needle to completely fill said orifice attached to the second end of said rod, said rod being of a length so that as the shaft is axially moved the cam follower and rod, in following said ramp, will move said needle out of and into said generator orifice.

2. The apparatus of claim 1 further comprising biasing means for maintaining contact between said cam follower and said ramp.

3. The apparatus of claim 2 wherein said biasing means comprises a helical spring, internal to said generator and in biasing contact with said cam follower.

4. A camp lantern valve assembly and generator comprising:

a hollow cylindrical valve housing closed at a first end comprising, in positional order from said first end, (a) an outlet port;

(b) a fuel inlet; and (c) an air inlet;

a cylindrical valve shaft adapted to slide into said housing comprising:

(a) a ramp; and (b) first and second seals for providing a seal between said shaft and said housing;

a hollow generator attached to said outlet port at one end and comprising an orifice at the other end;

a cam follower adapted to contact said ramp;

a rod internal to said generator and attached to said cam follower; and a needle attached to the other end of said rod, the needle diameter being slightly smaller than said orifice diameter;

the position of said ramp and said first and second seals being such that (a) when said shaft is fully advanced toward the first end, the cam follower is located at the high portion of said ramp, positioning said needle inside said orifice, and said second seal between said fuel inlet and outlet port;

(b) when said shaft is fully advanced toward the second end, the cam follower is located at a low portion of said ramp removing said needle from said orifice and positioning said second seal between said second end and said air inlet;

(c) when said valve shaft is in an intermediate position, the cam follower is located at a low point of said ramp removing said needle from said orifice and positioning said second seal between said fuel and air inlets; and (d) for all positions, the first seal is intermediate said air inlet and said second end.

5. The apparatus of claim 4 further comprising biasing means for maintaining contact between said cam follower and said ramp.

6. The apparatus of claim 5 wherein said biasing means comprises a helical spring, internal to said generator and in biasing contact with said cam follower.

7. The apparatus of claim 6 wherein said valve shaft and valve housing are threadedly engaged so that rotation of said valve shaft will slide the valve shaft between its three positions.

8. The apparatus of claim 7 wherein said first end of said housing is closed by a third seal mounted on said shaft and positioned so that it is always intermediate said first end and said outlet port.

* * * * *